US006496672B2

(12) United States Patent
Asuwa et al.

(10) Patent No.: US 6,496,672 B2
(45) Date of Patent: Dec. 17, 2002

(54) IMAGE PRODUCTION APPARATUS

(75) Inventors: Kenji Asuwa, Chiyoda (JP); Kazutaka Sato, Kashiwa (JP); Satoshi Shirasawa, Tsuchiura (JP); Shuho Yokokawa, Mito (JP); Isao Nakajima, Hitachinaka (JP); Yukio Otome, Toukai (JP)

(73) Assignees: Hitachi, Ltd., Tokyo (JP); Hitachi Koki Co., Inc., Tokyo (JP)

( * ) Notice: Subject to any disclaimer, the term of this patent is extended or adjusted under 35 U.S.C. 154(b) by 0 days.

(21) Appl. No.: 09/749,551

(22) Filed: Dec. 28, 2000

(65) Prior Publication Data

US 2002/0034400 A1 Mar. 21, 2002

(30) Foreign Application Priority Data

Sep. 20, 2000 (JP) ..... 2000-290341

(51) Int. Cl.[7] ..... G03G 15/00
(52) U.S. Cl. ..... 399/165; 399/299
(58) Field of Search ..... 399/165, 395, 399/51, 66, 299, 306, 301; 347/154, 232

(56) References Cited

U.S. PATENT DOCUMENTS 4,961,089 A * 10/1990 Jamzadeh ..... 226/21
5,225,877 A * 7/1993 Wong ..... 347/154
5,515,139 A * 5/1996 Hou et al. ..... 198/807
5,606,396 A * 2/1997 Yu et al. ..... 399/162
5,903,805 A * 5/1999 Ueda et al. ..... 399/165

FOREIGN PATENT DOCUMENTS

JP 08217302 A * 8/1996 ..... B65H/23/038
JP 09222827 A * 8/1997 ..... G03G/21/00

* cited by examiner

*Primary Examiner*—Robert Beatty
(74) *Attorney, Agent, or Firm*—Antonelli, Terry, Stout & Kraus, LLP

(57) ABSTRACT

An image production apparatus includes at least one image production unit having a latent image forming device for forming a latent image on an image carrying member and a developing device for attaching toner to the latent image formed by the latent image forming device. A toner image formed by the image production unit is transferred to a transfer medium to produce an image. The image production apparatus further includes a periodicity giving device for giving periodicity to movement in a main scanning direction of the image carrying member or transfer medium. According to this periodicity, the movement time from an image forming position to a transfer position, or the movement time of a transfer medium between adjacent transfer positions is set equal to an integral multiple of the period.

4 Claims, 5 Drawing Sheets

IMAGE PRODUCTION APPARATUS

BACKGROUND OF THE INVENTION

1. Field of the Invention

The present invention relates to an image production apparatus in which a latent image is formed on an image carrying member and toner is attached on the latent image so that the latent image is developed.

2. Description of the Related Art

In an image production apparatus of an electrophotographic system, there is known an image production apparatus using an endless belt as a photoconductive member constituting an image carrying member, an intermediate transfer member constituting a transfer medium or a conveying device of a paper sheet constituting a transfer medium. The belt is supported by means of a plurality of rollers and driven to be circulated. At this time, a meandering phenomenon that the belt is moved in the direction (main scanning direction) perpendicular to the conveying direction of the belt occurs occasionally.

When such a meandering phenomenon occurs, a position of the latent image formed on the photoconductive member and a position of the image produced on the transfer medium such as the intermediate transfer member and the paper sheet are varied and this variation distorts the image. Further, in a so-called tandem type color image production apparatus in which each of monochromatic images of black (hereinafter abbreviated as K), yellow (hereinafter abbreviated as Y), magenta (hereinafter abbreviated as M) and cyan (hereinafter abbreviated as C) is formed by a single image production unit and these monochromatic images are overlapped one another on the transfer medium to produce a color image, the variation among the image formation positions appear as variation in color among color toner images. The variation deteriorates the image quality and accordingly it is necessary to take any measures to the meandering of the belt in order to produce the high-quality image.

In order to cope with the above problem, various methods are proposed. These methods include, when broadly divided, a method of suppressing the meandering of the belt by means of the passive control, a method of suppressing the meandering of the belt by means of the active control and a method of detecting a meandering amount of the belt and correcting the image formation position in accordance with the detected meandering amount.

As the method of suppressing the meandering of the belt by means of the passive control, for example, JP-A-5-319611 discloses an edge guide provided in one of driven rollers so that thrust force is produced by a rib disposed in the roller to move the belt toward the edge guide and abut an edge of the belt against the guide by the thrust force to thereby prevent the meandering of the belt.

As the method of suppressing the meandering of the belt by means of the active control, for example, JP-A-3-288167, JP-A-8-217302 and JP-A-10-139202 disclose a meandering suppressing method using a so-called active steering system in which one of rollers for supporting the belt is caused to be swung so that the moving direction of the belt is controlled.

The method of detecting a meandering amount of the belt and correcting the image formation position in accordance with the detected meandering amount is disclosed in JP-A-9-222827, in which a predetermined allowable value is defined for the meandering amount and a correction amount is calculated from the meandering amount detected by the meandering amount detecting means so that a writing timing of the latent image by a laser is changed to thereby correct the writing position of the latent image in the main scanning direction.

However, when high-speed image production is considered, the above related art has the following problems.

In the technique of suppressing the meandering of the belt by means of the passive control, the edge of the belt is pressed on the edge guide and according when the belt is moved at a high speed, a large external force is exerted on the end portion of the belt so that the belt tends to be bent and broken. Further, each apparatus requires individual adjustment for differences in movement or behavior of individual belts due to a shape of the end portion of the belt, an assembly accuracy of the apparatus and the like.

In the technique of suppressing the meandering of the belt by means of the active control, when a moving speed of the belt is increased, it is necessary to perform detection and control of the meandering amount with high accuracy, so that configuration of the apparatus is complicated and a cost thereof is increased. Further, when a sudden disturbance such as variation in burden produced due to change in friction depending on entering of a paper sheet, operation of a cleaning device for an image carrying member and density of a toner image is added to the apparatus, it is difficult to perfectly suppress the meandering of the belt caused by such a sudden disturbance.

In the technique of detecting the meandering amount of the belt and correcting the image formation position in accordance with the detected meandering amount, it is essential to detect the meandering amount with high accuracy, so that the cost is increased. Further, it is necessary to make correction in consideration of the meandering amount of the belt upon transfer of a toner image in writing of a latent image, while the meandering of the belt is an irregular phenomenon generally and accordingly it is substantially impossible to forecast the meandering amount perfectly. This problem is more conspicuous in an actual image production process in which the disturbance is not avoided.

As described above, since it is difficult to forecast the movement of the belt in the main scanning direction exactly, the image formation position on the transfer medium is varied and the image quality is deteriorated.

SUMMARY OF THE INVENTION

It is an object of the present invention to provide an image production apparatus having an endless belt as an image carrying member and which produces an image at a high speed while preventing deterioration of the image quality due to movement (meandering of belt) in the main scanning direction of a belt member.

An image production apparatus according to the present invention includes at least one image production unit having a latent image forming device for forming a latent image on an image carrying member and a developing device for attaching toner to the latent image formed by the latent image forming device and a toner image formed by the image production unit is transferred to a transfer medium to form an image. Further, the image production apparatus includes a periodicity giving unit for giving periodicity to movement in a main scanning direction of the image carrying member and an amplitude of the period given by the periodicity giving unit is larger than a variation amount in the main scanning direction for determining reversal of the movement in the main scanning direction of the image carrying member.

The periodicity giving unit gives the periodicity to the movement in the main scanning direction of the image carrying member or the transfer medium. When the image carrying member or the transfer medium is structured by an endless belt, there are provided a belt position detector for detecting a position in the main scanning direction of the endless belt, a roller having a rotatable shaft held swingably, a roller swinging mechanism for swinging the rotatable shaft of the roller and a control unit for controlling the roller swinging mechanism so that the movement in the main scanning direction of the belt becomes periodic on the basis of the result of the belt position detector. An amplitude of the period of the endless belt is larger than a variation amount of the belt for determining control for reversing the roller swinging mechanism.

Further, the image production apparatus of the present invention may include a writing position control unit for correcting a write position to the image carrying member of the latent image writing device in accordance with the period of the movement in the main scanning direction of the endless belt.

An image production method of the present invention comprises writing a latent image to an image carrying member by means of a latent image writing device, developing the latent image with toner to form a toner image, detecting a positional variation in a main scanning direction of an endless belt on which the latent image or toner image is formed when the toner image is transferred to a printing medium, giving periodicity to movement in the main scanning direction of the endless belt on the basis of the detected result, and correcting a latent image formation position with respect to the image carrying member on the basis of the periodicity.

DESCRIPTION OF THE EMBODIMENTS

An embodiment of the present invention is now described with reference to the accompanying drawings.

Figure 1:
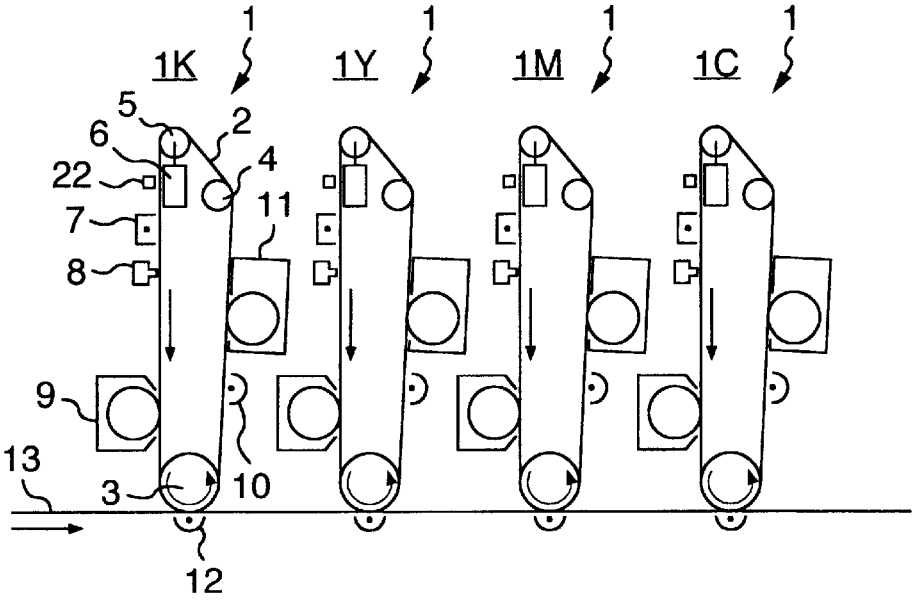
FIG. 1 is a schematic diagram illustrating an image production apparatus according to a first embodiment of the prevent invention.

FIG. 1 is a schematic diagram illustrating an image production unit of a fully-colored tandem type image production apparatus according to a first embodiment of the present invention. In this configuration, there are provided image production units 1K, 1Y, 1M and 1C for producing monochromatic toner images of K, Y, M and C, respectively. In FIG. 1, reference numerals are designated to constituent elements only in the image production unit 1K, while other image production units 1 also have the same configuration.

Each of the image production units 1 include s an endless belt constituting an image carrying member or member 2, a latent image forming device 8 for writing or forming a latent image on the image carrying member 2 having a surface charged with electricity by a charger 7 uniformly, and a developing device 9 for developing the latent image formed on the image carrying member 2.

Toner is attached to the latent image by the developing device 9 to form a toner image and the toner image is transferred to a printing medium 13 conveyed in a transfer portion 12. Four monochromatic images of K, Y, M and C are separately formed by the four image production units 1, respectively, and are overlapped one another on the printing medium 13 to thereby form a color image.

After the toner image on the image carrying member 2 has been transferred to the record medium, the image carrying member 2 is neutralized by an eraser 10 and excessive toner left on the surface of the image carrying member is then removed by a cleaner 11.

A driving mechanism for driving the image carrying member 2 constituted by the endless belt in the image production unit 1 is structured as follows.

A driving roller 3 is mounted rotatably by means of its shaft and is rotated by a driving source not shown to drive the image carrying member 2 constituted by the endless belt by its rotation. An idle roller 4 is also mounted rotatably by means of its shaft in the same manner as the driving roller 3 and is rotated so as to follow movement of the image carrying member 2.

The steering roller 5 is supported rotatably by means of its shaft as described above and positions where ends of the shaft are supported are adapted to be changed by means of actuators 6.

Further, the image production unit 1 includes a position detector 22 for detecting a position in the main scanning direction of the image carrying member 2.

In the embodiment, the shaft of the steering roller 5 is not fixed and can be moved, so that the position of the rotatable shaft of the roller can be changed by the actuators 6. The driving mechanism of the steering roller 5 is now described with reference to FIG. 2 in detail.

Figure 2:
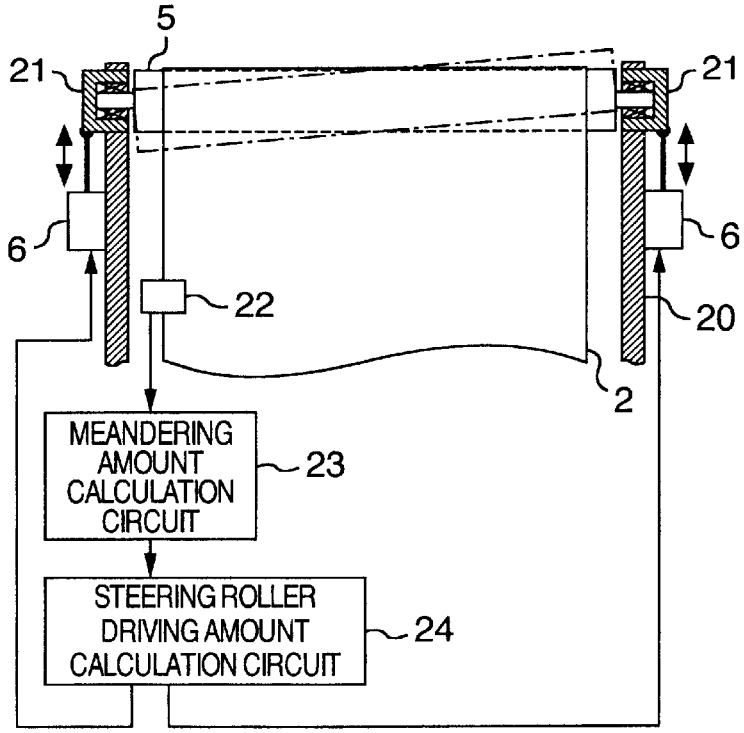
FIG. 2 is a diagram for explaining a driving mechanism of a steering roller.

In FIG. 2, bearings 21 for the steering roller 5 are supported by the actuators 6 fixedly mounted to a frame 20. The actuators 6 drive the bearings 21 in the direction shown by arrow in FIG. 2. The bearings 21 are displaced or moved by being driven by the actuators 6, so that the steering roller 5 is swung.

The parallel relationship between the driving roller 3 and the steering roller 5 is changed by the swinging operation of the steering roller 5 in the embodiment, so that movement (meandering) in the main scanning direction of the endless belt constituting the image carrying member 2 can be controlled.

The position of the end portion of the endless belt 2 in the width direction is detected by a position detector 22 and a meandering amount which is a displacement amount in the main scanning direction of the endless belt 2 is calculated on the basis of the detected result by means of a meandering amount calculation circuit 23. A steering roller driving amount calculation circuit 24 calculates a driving amount of the actuators 6 in accordance with change of the meandering amount which is the calculated result and controls to drive the actuators 6 so that the periodicity is given to the movement in the main scanning direction of the endless belt 2.

Figure 3:
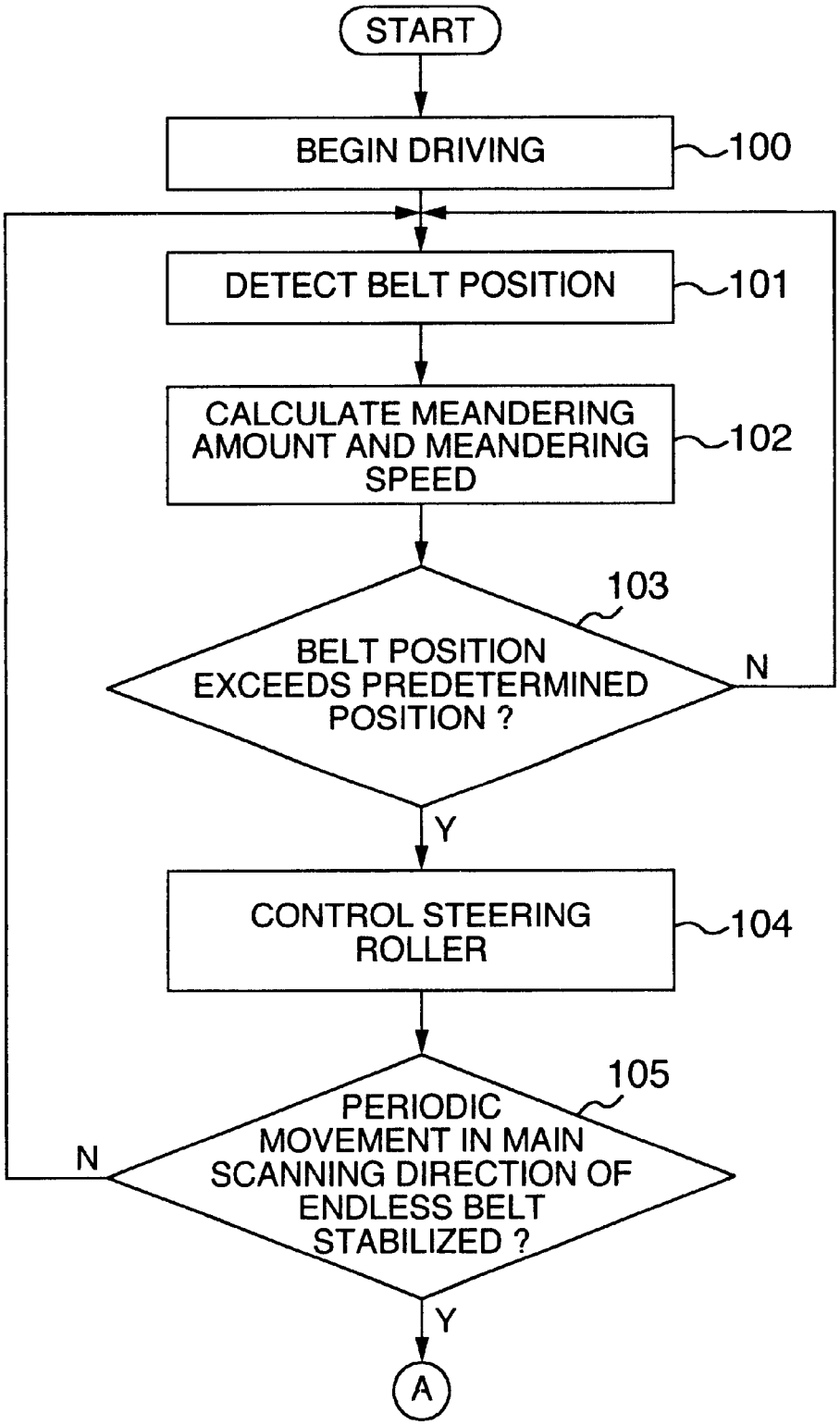
FIG. 3 is a flow chart showing a processing procedure of giving the periodicity to meandering of a belt.

In the image production apparatus of the embodiment, the shaft of the steering roller 5 is moved periodically by the actuators 6 to thereby give the periodicity to the movement in the main scanning direction of the endless belt 2. The processing of giving the periodicity to the movement in the main scanning direction of the endless belt will be described with reference to FIG. 3.

The endless belt 2 begins to be driven (step 100). The endless belt 2 is meandered in one direction together with rotation of the driving roller due to mechanical errors such as a difference in length of peripheral end portions of the endless belt 2 and deviation of the parallel relationship of the rollers for supporting the endless belt.

The position detector 22 detects the position of the end portion in the main scanning direction of the endless belt 2 (step 101) and supplies the detected result to the meandering amount calculation circuit 23. The meandering amount calculation circuit 23 calculates the meandering amount of the endless belt and supplies the meandering amount to the steering roller driving amount calculation circuit 24. The meandering amount is an amount for expressing how much a specific position of the endless belt 2 is moved in the main scanning direction. The driving amount calculation circuit 24 calculates a meandering speed on the basis of a displacement of the inputted meandering amount (step 102).

The driving amount calculation circuit 24 judges whether the specific position of the endless belt 2 exceeds a position previously set in the steering roller 5, for example a center position of the steering roller 5 on the basis of the displacement of the meandering amount (step 103) and when the predetermined position is not exceeded, comparison in displacement of the meandering amount is continued. When the position of the end portion of the endless belt 2 exceeds the predetermined position, that is, when the position of the end portion of the endless belt 2 exceeds a change or displacement amount for determining reversal of the movement in the main scanning direction of the endless belt 2, the driving amount calculation circuit 24 controls the actuators 6 so as to vary the position of the shaft of the steering roller 5 (step 104).

In order to suppress the meandering, the actuator 6 moves the position of the shaft of the steering roller 5 so that the endless belt 2 is moved in the direction opposite to the meandering direction. More particularly, the actuator 6 is controlled so that the end of the shaft of the steering roller 5 disposed in the direction opposite to the meandering direction of the endless belt 2 approaches the driving roller 3. This operation reduces the meandering speed of the endless belt 2 and once stops movement in the first meandering direction. Then, the meandering operation in the opposite direction is started.

In the embodiment, when the aforementioned predetermined position is exceeded after the endless belt 2 has started meandering in the opposite direction to the first meandering direction, the parallel relationship or parallel degree of the steering roller 5 is controlled in the opposite direction to the above-mentioned direction by means of the actuator 6. In this manner, the steering roller 5 is moved by the actuator 6 so that the meandering direction of the endless belt 2 is changed after the endless belt 2 has come to the position on the side opposite to the side in the first meandering direction with respect to the predetermined position.

Such an operation is repeatedly performed until the periodic movement of the endless belt 2 in the main scanning direction is stabilized so as to center the predetermined position (step 105). Further, since the position of the shaft of the steering roller 5 is controlled in consideration of change of the meandering speed, it is easy to follow variation of the period due to disturbance. Control performed after the period of the meandering has been stabilized is described later.

Figure 4:
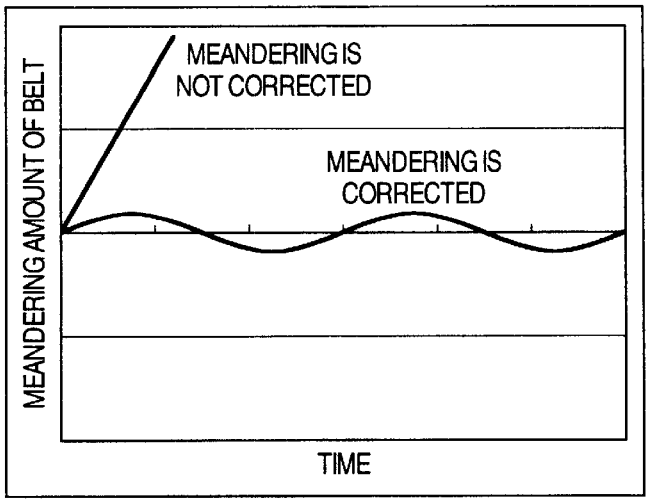
FIG. 4 is a diagram for explaining a method of correcting a latent image formation position in case where the periodicity is given to movement of an endless belt in the main scanning direction.

Such movement of the endless belt 2 is schematically illustrated as in FIG. 4. When the above control is not made, the endless belt 2 is meandered in one direction with time, while by giving the periodicity disclosed in the embodiment to the endless belt 2 constituting the image carrying member, the endless belt 2 is moved periodically in the main scanning direction so as to center the predetermined position.

The period of the periodic movement of the endless belt 2 described in the embodiment can be calculated from a period in the case where the steering roller 5 is previously set to be moved periodically. Further, the period in accordance with the control method of the actuator 6 described later can be also measured by belt position detection means. An amplitude uses a value detected by the position detector 22 for detecting the position of the end portion in the main scanning direction of the belt, while movement in the main scanning direction of the belt is previously forecasted experimentally or analytically and the forecasted value can be used as the amplitude.

The meandering control of the belt performed after the meandering period has been stabilized is now described.

Figure 5:
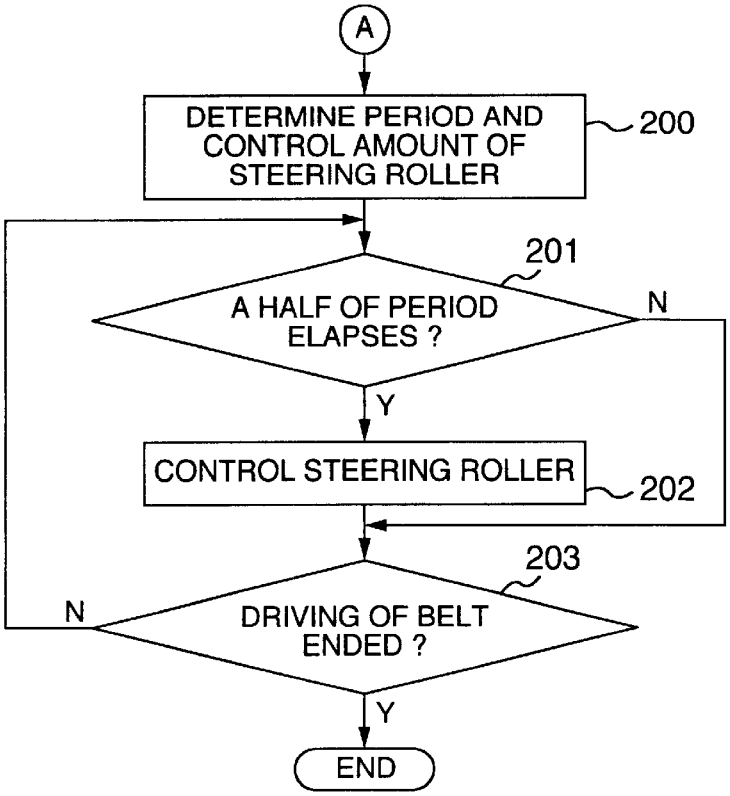
FIG. 5 is a flow chart showing a procedure of controlling a position of a belt in case where the period of meandering of a belt is previously set.

FIG. 5 shows a control procedure of the belt position in case where the meandering period of the belt is previously set. First of all, the steering roller driving amount calculation circuit 24 sets the period and a control amount of the steering roller 5 on the basis of the stabilized period (step 200). The driving amount calculation circuit 24 detects from the elapse of time whether a half of the period of the belt movement elapses or not (step 201) and controls the steering roller 5 on the basis of the previously set operation amount when a half of the period has elapsed (step 202). The same control is performed until driving of the belt is ended (step 203).

Figure 6:
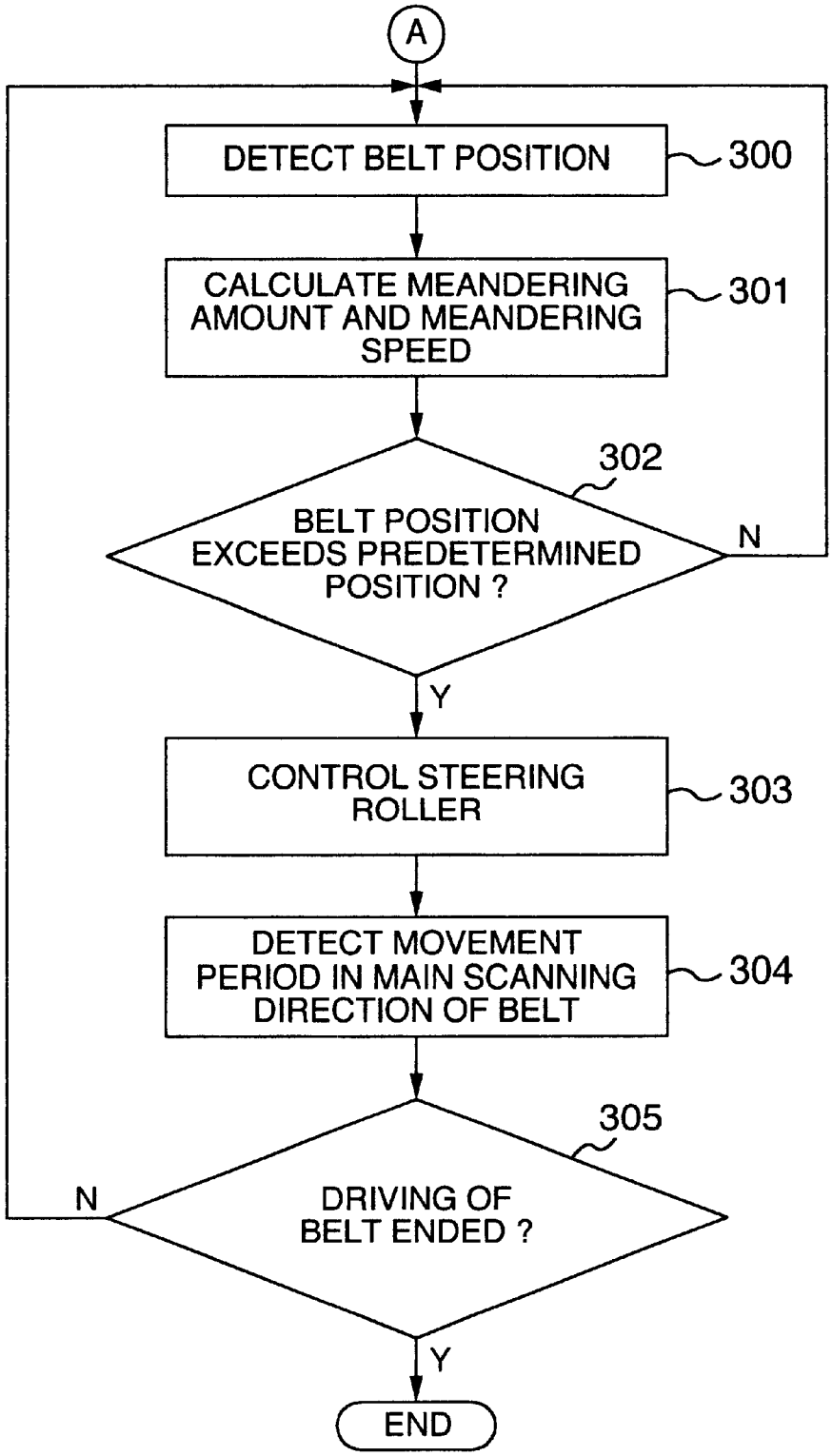
FIG. 6 is a flow chart showing a procedure of controlling a position of a belt in case where the period of meandering of a belt is detected successively.

FIG. 6 shows a control procedure of the belt position in case where the meandering period of the belt is successively detected. Processing operation in steps 300 to 303 is the same as in steps 101 to 104 of FIG. 3. After the steering roller 5 is controlled (step 303), the driving amount calculation circuit 24 calculates the movement (meandering) period in the main scanning direction of the belt (step 304). The same control is performed until driving of the belt is ended 5 (step 305).

As described above, the period of the operation or control of the steering roller can be set previously as shown in FIG. 5 or the period in accordance with the control method of the actuator 6 can be measured by the position detector 22 successively as shown in FIG. 6. In the embodiment, the value detected by the belt position detector 22 is used as the amplitude of the meandering, while movement in the main scanning direction of the belt is previously forecasted experimentally or analytically and the forecast value can be used as the amplitude.

Figure 7:
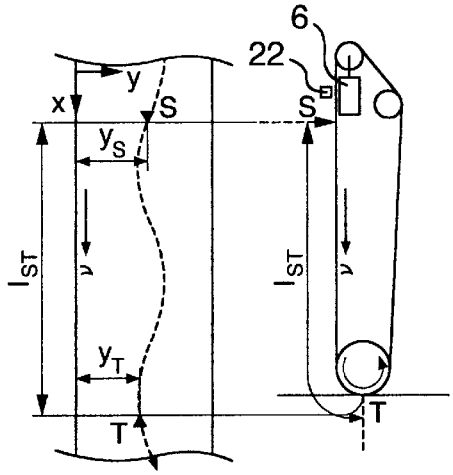
FIG. 7 is a diagram for explaining an example where the periodicity is given to meandering of a belt in the first embodiment of the present invention.

FIG. 7 is a diagram for explaining the method of correcting the latent image formation position in case where the periodicity is given to movement in the main scanning direction of the endless belt constituting the image carrying member 2. When the meandering of the belt has the periodicity, the locus of the belt passing through the target transfer point T is shown by a dotted line in FIG. 7. A variation of the position in the main scanning direction at a latent image formation point S is calculated from the locus of the belt and the latent image formation position is corrected. More particularly, when the meandering of the belt is given by the following expression in respect to time t with the amplitude Ap and the period Tp used or calculated in the driving amount calculation circuit 24, $$y=Ap\ \sin(2\pi t/Tp)$$

the correction amount of the latent image formation position $y_S$ for the transfer position $y_T$ is given by $$y_S-y_T=Ap[\sin(2\pi t/Tp)-\sin\{2\pi(t+l_{ST}/v)\}]$$

where $l_{ST}$ is a distance in the sub-scanning direction between the latent image formation point and the transfer point and v is a belt conveying speed.

In the embodiment, the latent image formation position is corrected on the basis of the correction amount thereof thus calculated. For example, when the latent image formation means is a laser, the correction is made by changing the laser writing timing. Further, when the latent image formation means is an array of light emitting diodes, the correction is made by changing the light emitting position of the array.

As described above, the meandering amount of the belt at a certain time and at a certain position can be forecasted with high accuracy by giving the periodicity to the movement in the main scanning direction of the endless belt 2 constituting the image carrying member. The periodicity can be utilized to correct the latent image formation position, so that the image can be produced on a predetermined position of the transfer medium with high accuracy.

In the embodiment, means for giving the periodicity to the movement in the main scanning direction of the endless belt moves the position of the steering roller 5, while it is not necessarily required to move the position and the tension exerted on both ends of the belt by the steering roller 5 may be changed.

Further, when a movement time of the belt from the latent image formation point to the transfer point is an integral multiple of the meandering period of the belt, that is, when the following expression is satisfied, $$L_{ST}/v=nTp$$

(where n is any natural integer) $y_{S-yT}=0$ is always effected and accordingly the correction of the latent image formation position may be omitted.

In the embodiment, the color printer having a plurality of image production units is exemplified, while it is needless to say that the present invention can be applied to a monochromatic image production apparatus having a single image production unit.

Figure 8:
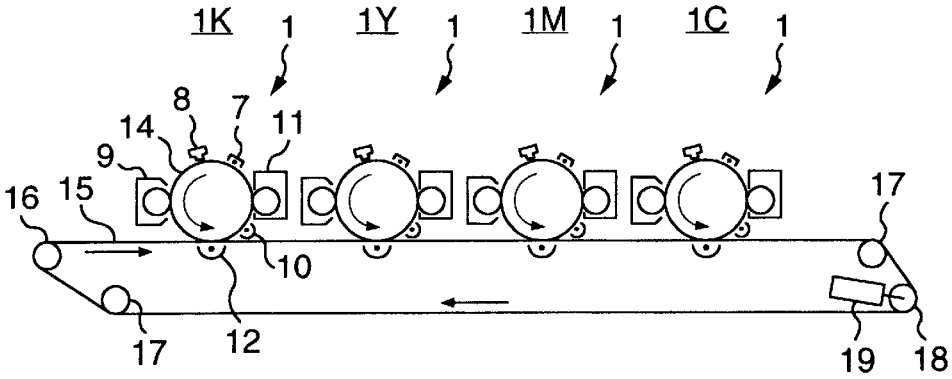
FIG. 8 is a schematic diagram illustrating an image production apparatus according to a second embodiment.

FIG. 8 schematically illustrates an image production apparatus according to a second embodiment of the present invention. In this embodiment, images produced by image production units 1K, 1Y, 1M and 1C for producing monochromatic toner images of K, Y, M and C, respectively, are transferred to an intermediate transfer belt 15 constituting a transfer medium having a form of an endless belt to be overlapped one another successively so that a color image is produced and then the color image is transferred to a paper sheet by means of transfer means not shown.

An image production unit includes a photoconductive drum 14, a latent image forming device 8, a developing device 9, a cleaner 11, a charger 7 and a neutralizer 10 for the image production unit 1K, for example. The basic structure is the same as the image production unit 1 shown in FIG. 1, while the image carrying member 2 is replaced by the photoconductive drum 14. Other image production units have the same structure.

A driving device for the intermediate transfer belt in the embodiment includes a driving roller 16, an idle roller 17, a steering roller 18, an actuator 19 and belt position detection means not shown. The same method as the first embodiment is used to give the periodicity to movement in the main scanning direction of the intermediate transfer belt constituting the transfer medium.

Figure 9:
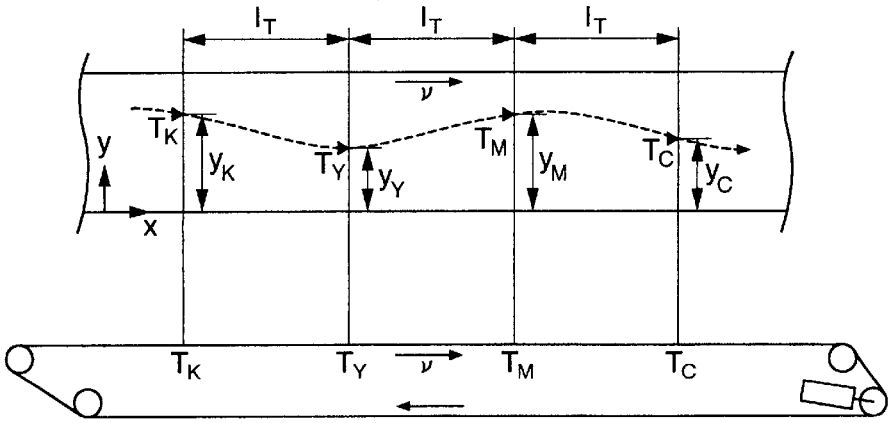
FIG. 9 is a diagram for explaining an example where the periodicity is given to meandering of a belt in the second embodiment of the present invention.

FIG. 9 is a diagram for explaining the correction method of the transfer position in the second embodiment. When the meandering of the belt has the periodicity, the locus of the belt passing through a target transfer point $T_K$ for K toner is shown by a dotted line of FIG. 9 when the image of K is considered as a reference. Positional variations in the main scanning direction at transfer points $T_Y$, $T_M$ and $T_C$ for Y, M and C toner are calculated from the locus of the belt and the latent image position is corrected. More particularly, when the meandering of the belt is given by the following expression in respect to time t with the amplitude Ai and the period Ti, $$y_Y=Ai\ \sin(2\pi t/Ti)$$

the correction amounts for the transfer positions of Y, M and C with respect to the transfer position $Y_K$ of K are given by $$y_Y-y_K=Ai[\sin(2\pi t/Ti)-\sin\{2\pi(t+l_T/v)\}]$$

$$y_M-y_K=Ai[\sin(2\pi t/Ti)-\sin\{2\pi(t+2\times l_T/v)\}]$$

$$y_C-y_K=Ai[\sin(2\pi t/Ti)-\sin\{2\pi(t+3\times l_T/v)\}]$$

where $l_T$ is a distance in the sub-scanning direction between adjacent transfer points and v is a belt conveying speed.

The image production position is corrected on the basis of the image production position correction amount thus calculated in the same manner as the first embodiment. The reference is not limited to K and any of Y, M and C can be selected therefor.

As described above, the meandering amount of the belt at a certain time and at a certain position can be forecasted with high accuracy by giving the periodicity to the movement in the main scanning direction of the intermediate transfer belt constituting the transfer medium. The periodicity can be utilized to correct the latent image formation position, so that the image can be produced on a predetermined position of the transfer medium with high accuracy.

Further, when the movement time of the belt between the adjacent transfer points is the integral multiple of the meandering period of the belt, that is, when the following expression is satisfied, $$L_T/v=nTi$$

(where n is any natural integer) the positional variation is always 0 and accordingly the correction of the latent image formation position may be omitted.

In the embodiment, the transfer medium is shown as the intermediate transfer member, while the transfer medium may be a paper sheet attached to the paper conveying belt or may be an web conveyed by the roller. In this case, the control means for giving the periodicity to the movement in the main scanning direction is provided in the driving device for the paper conveying belt or the driving device for conveying paper.

The image production unit in the second embodiment includes the photoconductive drum as the image carrying member, while the image production unit may include a photoconductive belt. In this case, correction of the position can be made by the method described in the first embodiment.

Furthermore, in the first and second embodiment, the image production unit includes the latent image forming means and the developing means, while the method of forming an image on the transfer medium directly as a printing head for an ink jet printer may be used. In this case, an ink jet position can be corrected by the correction processing used in the above embodiment.

With the configuration described in the embodiments, it is not necessary to detect and control the position of the belt with high accuracy and the cost required for the detection and control of the position of the meandering belt can be suppressed to low. Further, since the belt is always disposed under influence of thrust force, influence of external disturbance is reduced. Since the position of the belt at any time can be forecasted by utilizing the periodicity of the meandering, the image with high quality and no positional variation can be produced.

What is claimed is:

1. An image production apparatus including at least one image production unit having a latent image forming device for forming a latent image on an image carrying member and a developing device for attaching toner to said latent image formed by said latent image forming device and wherein a toner image formed by said image production unit is transferred to a transfer medium to form an image, wherein movement in a main scanning direction of said image carrying member has periodicity and a movement time of said image carrying member from a latent image formation position to a transfer point is equal to an integral multiple of said period.

2. An image production apparatus including a plurality of image production units each having a latent image forming device for forming a latent image on an image carrying member and a developing device for attaching toner to said latent image formed by said latent image forming device and wherein toner images formed by said image production units are transferred to a transfer medium to form an image, wherein movement in a main scanning direction of said transfer medium has periodicity and a movement time of said transfer medium between transfer points of said adjacent image production units is equal to an integral multiple of said period.

3. An image production apparatus including at least one image production unit having a latent image forming device for forming a latent image on an image carrying member and a developing device for attaching toner to said latent image formed by said latent image forming device and wherein a toner image formed by said image production unit is transferred to a transfer medium to form an image, comprising a periodicity giving device for giving periodicity to movement in a main scanning direction of said image carrying member, a movement time of said image carrying member from a latent image formation position to a transfer point being equal to an integral multiple of said period.

4. An image production apparatus including plurality of image production units each having a latent image forming device for forming a latent image on an image carrying member and a developing device for attaching toner to said latent image formed by said latent image forming device and wherein toner images formed by said image production units are transferred to a transfer medium to form an image, comprising a periodicity giving device for giving periodicity to movement in a main scanning direction of said transfer medium, a movement time of said transfer medium between transfer points of said adjacent image production units being equal to an integral multiple of said period.

* * * * *